United States Patent [19]

Tsuda et al.

[11] Patent Number: 4,692,597

[45] Date of Patent: Sep. 8, 1987

[54] HEATING APPLIANCE WITH UNIFORM HEATING CONTROL

[75] Inventors: Tatsuya Tsuda, Osaka; Masako Nogi, Nara, both of Japan

[73] Assignee: Sharp Kabushiki Kaisha, Osaka, Japan

[21] Appl. No.: 808,486

[22] Filed: Dec. 13, 1985

[30] Foreign Application Priority Data

Dec. 14, 1984 [JP] Japan ..... 59-265071

[51] Int. Cl.[4] ..... H05B 6/68

[52] U.S. Cl. ..... 219/492; 219/10.55 B; 99/325

[58] Field of Search ..... 219/10.55 B, 10.55 M, 219/10.55 R, 10.55 E, 492, 494; 99/325, 326, 332

[56] References Cited

U.S. PATENT DOCUMENTS

| | | | |
|---|---|---|---|
| 4,097,707 | 6/1978 | Kobayashi et al. | 219/10.55 B |
| 4,401,884 | 8/1983 | Kusunoki et al. | 219/492 |
| 4,453,066 | 6/1984 | Mori | 219/10.55 M |
| 4,463,238 | 7/1984 | Tanabe | 219/10.55 B |
| 4,467,164 | 8/1984 | Nakata et al. | 219/10.55 M |
| 4,520,251 | 5/1985 | Yokozeki | 219/10.55 M |

*Primary Examiner*—Philip H. Leung

*Attorney, Agent, or Firm*—Birch, Stewart, Kolasch & Birch

[57] ABSTRACT

A heating appliance includes a heating circuit for heating an object disposed in a heating chamber, a detection circuit for detecting heat completion of the heated object, and a switch for switching between different power levels of the heating circuit prior to heat completion detecting by the detection circuit, heat completion being detected when the output of a sensor within the detection circuit reaches a predetermined value.

5 Claims, 5 Drawing Figures

HEATING APPLIANCE WITH UNIFORM HEATING CONTROL

BACKGROUND OF THE INVENTION

The present invention relates to a heating appliance and, more particularly, to a heating appliance such as a microwave oven, an electric oven, or the like, which can uniformly heat an object such as a frozen food.

In a microwave oven of a related art of the present invention, if frozen objects such as frozen hamburgers are heated for thawing, it is difficult for the frozen objects to be uniformly thawed. If a plurality of frozen objects are disposed in a heating chamber, some of the objects are heated by the microwaves with high electric field intensity making the objects excessively heated, while some of the remaining objects are heated by the microwaves with low electric field intensity to with the objects being unheated. For example, six frozen hamburgers A–F are disposed in the heating chamber as shown in FIG. 5, a heat completion temperature of each of the six frozen hamburgers A–F is shown in Table 1. The heating completion temperature for each hamburger should range from 65 degrees C. to about 70 degrees C. in a medium type heating. However, in the microwave oven of the related art, the heat completion temperature for each hamburger ranges from about 40 degrees C. to about 83 degrees C. The range of the temperature varies widely, and good heat completion cannot be obtained.

SUMMARY OF THE INVENTION

Accordingly, it is an object of the present invention to provide an improved heating appliance which can uniformly heat an object with multiple levels of heating power energy.

It is another object of the present invention to provide an improved heating appliance which can uniformly heat and thaw a frozen object by changing or switching the heating power levels of a heating source.

It is a further object of the present invention to provide an improved heating appliance which switches heating power levels of a heating source to different levels for one heating cycle.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

To achieve the above objects, according to an embodiment of the present invention, a heating appliance comprises heating means for heating an object, detection means for detecting heat completion of the heated object, and switching means for switching power levels of the heating means from a first level to a second level before the output of the detection means reaches a predetermined value.

The power level of the heating means may be changed or switched multiple times before the output of the detection means is equal to or greater than the predetermined value.

An additive heating period may be carried out after the output of the detection means is equal to or greater than the predetermined value by energizing the heating means.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE PREFERRED EMBODIMENTS

Figure 1:
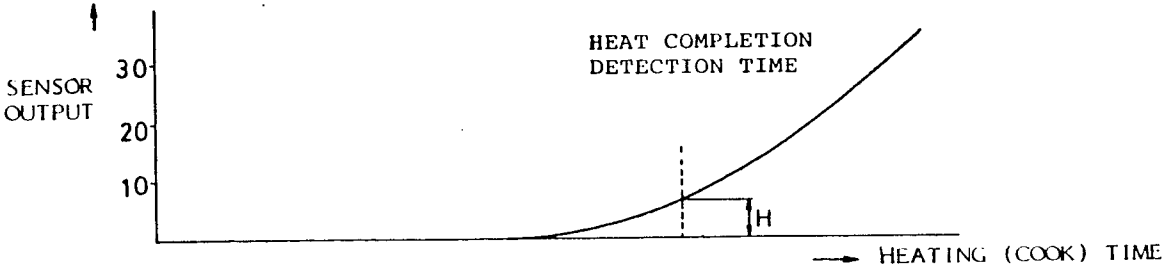
FIG. 1 shows a relationship between a heating period of time and a sensor output in a microwave oven according to an embodiment of the present invetion.
Figure 2:
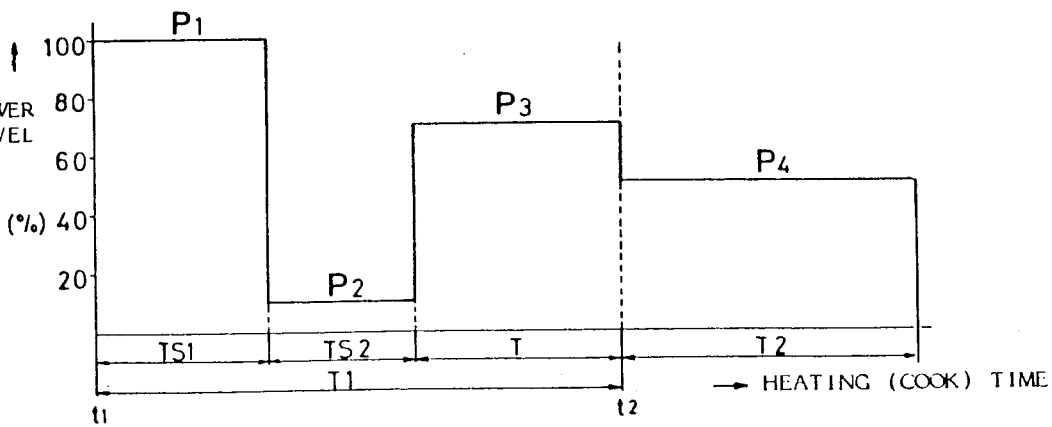
FIG. 2 shows a relationship between a heating period of time and a power level of a magnetron in the microwave oven according to the embodiment of the present invention.
Figure 3:
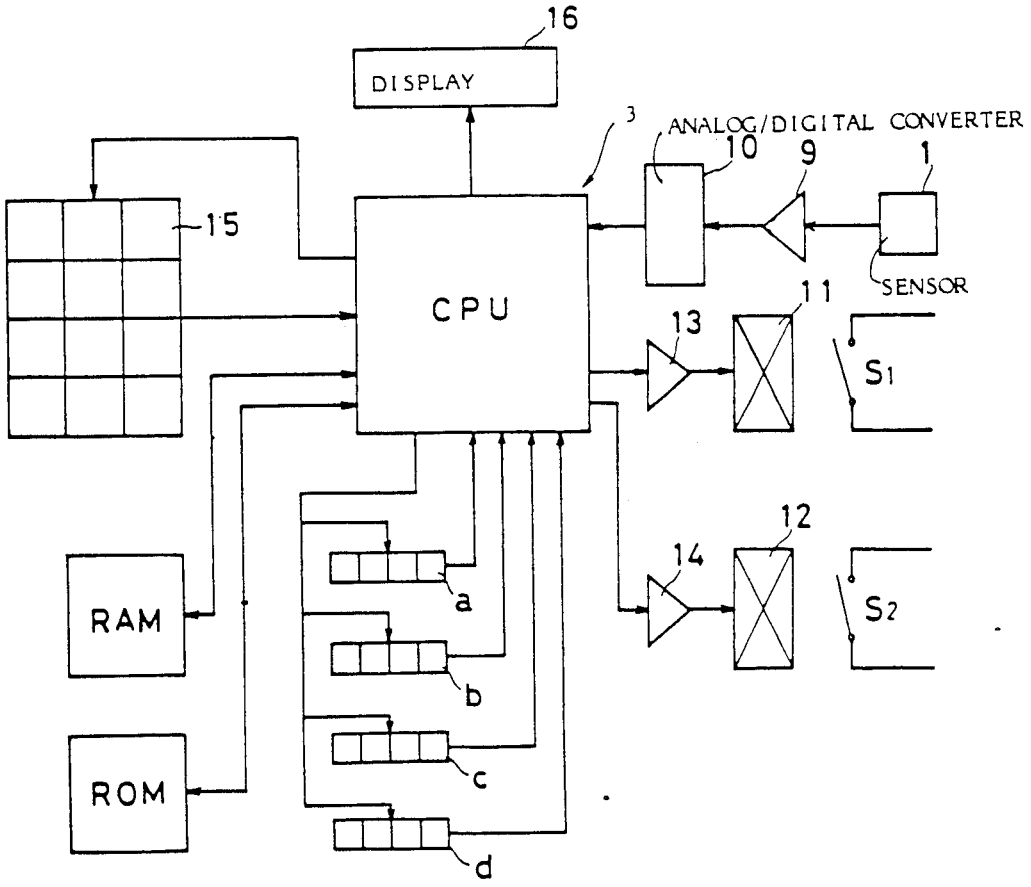
FIG. 3 shows a block diagram of a control circuit used in the microwave oven of the present invention.
Figure 4:
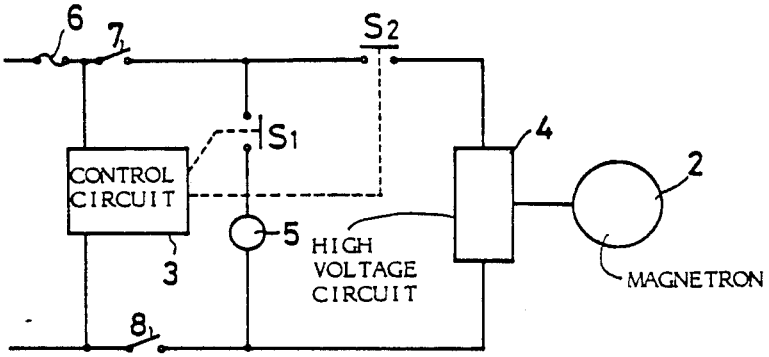
FIG. 4 shows a circuit diagram of the microwave oven according to the embodiment of the present invention.
Figure 5:
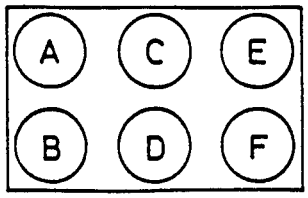
FIG. 5 shows an arrangement of frozen hamburgers A–F.

A preferred embodiment of the present invention is now described in terms of a microwave oven although not limited to the microwave oven. The present invention may be applied to various heating apparatus other than the microwave oven. FIG. 1 shows the relationship between a heating period of time and a sensor output in a microwave oven according to an embodiment of the present invention. FIG. 2 shows the relationship between a heating period of time and a power level of a magnetron in the microwave oven according to the embodiment of the present invetion. FIG. 3 shows a block diagram of a control circuit used in the microwave oven according to the embodiment of the present invention. FIG. 4 shows a circuit disgram of the microwave oven according to the embodiment of the present invention. FIG. 5 shows an arrangement of frozen hamburgers A–F.

The microwave oven according to the embodiment of the present invention comprises a heating source such as a magnetron 2 for heating an object disposed in a heating chamber, sensor means 1 for detecting conditions in the heating chamber, and a control circuit 3 for controlling a power level of the heating source responsive to the output of the sensor means.

The sensor means may be a gas sensor for detecting gas in the heating chamber or in the exhaust air from the heating chamber, a humidity sensor for detecting humidity or vapor amount in the heating chamber or in the exhaust air from the heating chamber, a temperature sensor such as a thermister for detecting a temperature or heat in the heating chamber or in the exhaust air from the heating chamber.

The control circuit comprises a microcomputer and is operated to calculate a heat completion condition of the heated object responsive to the output signal of the sensor means 1, and control the power of the heating source, such as the magnetron 2, based on the calculated heat completion condition.

The microwave oven, further, comprises switching means for switching the power levels of the heating source such as the magnetron 2 between a heating start time t1 and a heat completion detection time t2. The heating start time t1 is the time at which heating is started. The heat completion detection time t2 is the time when the output of the sensor means reaches a heat completion value H determined by the quality of the object to be heated and the amount of the object to be heated.

When the heating of the microwave oven is carried out, the power level of the magnetron 2 is changed from a first power level to a second power level, and then from the second power level to a third power level by the switch means. The first power level and the third power level are greater than the second power level. In other words, a high voltage transformer is turned on and off to higher or lower values to change the power level of the magnetron 2. The control circuit 3 may comprise this switching means.

The microwave oven including the control circuit 3 having the switch means will be described below, but the control circuit 3 need not include the switch means. The heating operation of the microwave oven of the present invention will be described below.

As shown in FIG. 2, the object disposed in the heating chamber is heated by a first power level P1 of the heating source from the heating start time t1 for a first heating period TS1. The first power level is at about the full (about 100%) power level of the heating source.

Following the first power level P1 heating, a second power level P2 heating is carried out for a second heating period TS2. For example, the second power level P2 is at about the 10% power level of the heating source. After the second power level P2 heating, the object is heated by a third power level P3 of the heating source for a period T until the heat completion detection time t2. For example, the third power level P3 is at about the 70% power of the heating source.

After heat completion is detected, an additive heating is carried out by a fourth power level P4 for an additive heating period T2 to enhance good heat completion. For example, the fourth power level P4 of the power source is at about the 50% power level of the heating source. The additive heating period T2 is determined based on the heating period T1 from the heating start time t1 to the heat completion detection time t2 when the output of the sensor means 1 reaches the predetermined heat completion value H. The additive heating period T2 is calculated as follows.

$$T2 = N \times T1$$

where N is a constant value which is determined by the kind of the object such as the food. Therefore, the forth power level P4 heating (namely, the additive heating) is carried out for the period T2=N×T1. The heating for cooking is stopped after the period T2.

To thaw the frozen object, the first power level and the second power level heatings should at least be carried out.

When the frozen hamburgers A–F as shown in FIG. 5 are heated by the above heating operation including the four power level heatings, the range of heat completion temperatures of the frozen hamburgers A–F varies from about 58 degrees C. to about 73 degrees C., so that good heat completion can be obtained.

TABLE 1

| | A | B | C | D | E | F |
|---|---|---|---|---|---|---|
| Related Art Device | 76 | 79 | 40 | 43 | 83 | 69 |

TABLE 1-continued

| | A | B | C | D | E | F |
|---|---|---|---|---|---|---|
| Present Invention | 65 | 66 | 58 | 61 | 73 | 71 |

In the present invention, the frozen objects are heated and thawed to a certain extent by the first power level P1 heating at about the 100% power level of the heating source. After the first power level P1 heating, the second power level P2 heating, at a lower power level heating, is carried out so that the heat of the object will expand within the inner portion of the object by using the heat conductivity of the object itself to provide a uniform heat distribution. The first heating period TS1 of the first power level P1 heating and the second heating period TS2 of the second power level P2 heating provide a good condition for thawing the frozen object. For the period T, the thawed object is heated by the third power level P3 of the power source for cooking. In this case, the power level of the magnetron 2 for the period T, before the output level of the sensor means reaches the predetermined heat completion value H, namely, before the heat completion detection time t2, may be a relatively higher power level P3 (for example, about a 70% power level of the heating source). Whereupon, the vapor or the gas is remarkably discharged from the heated object (food), and the output of the sensor means is remarkably changed. The variations of the period T1 from the heating start time t1 to the heat completion detection time t2, thus may be reduced. As a result, the heated condition of the frozen object such as the frozen hamburger can be improved without a variance in the heated condition.

As described above, the microwave oven comprises the sensor means for detecting the heat completion of the object, and the switching means for switching the power levels of the magnetron 2, for example, from the first level to the second level, and then from the second level to the third level, to obtain an improved heated completion condition of the object.

In FIG. 4, a high voltage circuit 4 is provided for generating the microwaves from the magnetron 2, with the high voltage transformer. The electric power is applied to the high voltage circuit 4 from a commercial power source. A fan motor 5 is provided for introducing the gas, the heat, or the like from the heating chamber, by rotating a fan, to the sensor means 1 provided in or adjacent to the heating chamber, for use in determining whether to output the detection signal of the sensor means 1. The fan motor 5 and the high voltage transformer of the high voltage circuit 4 are controlled by the control circuit 3 as follows. A second contact S2, connected to the high voltage transformer in series, is switched on and off so that the power levels of the magnetron 2 are changed and switched based on the ON period of time and the OFF period of time. In the embodiment, the power level of the magnetron 2 is selected from four levels based on the ratio between the ON period and the OFF period of the second relay constant S2. The four levels are the first power level P1 (for example, about 100%), the second power level P2 (for example, about 10%), the third power level P3 (for example, about 70%), and the forth power level P4 for the additive heating (for example, about 50%). When a first relay contact S1 connected to the fan motor 5 in series, is switched on, the sensor means 1 is operated to detect the heat completion condition of the heated object. A fuse is designated by 6, and first and second interlock switches are designated by 7 and 8.

In FIG. 3, the control circuit 3 comprises a central processing unit CPU, a random access memory RAM, a read only memory ROM, registers a, b, c, and d. The output signal of the sensor means 1 is applied to the CPU through an amplifier 9 and an analog/digital (A/D) converter 10. The output of the CPU, responsive to the output signal of the sensor means 1, is applied to driver circuits 13 and 14. The driver circuits 13 and 14 are operated to drive first and second relay coils 11 and 12 so as to switch on and off the first and the second relay contacts S1 and S2, respectively. A keyboard 15 is provided for inputting information relating to the heating. A display circuit 16 is provided for displaying the heating condition, such as the temperature of the heated object, and a menu key number such as an "automatic heating" key.

The operation of the microwave oven will be described below. When a selection signal, which indicates the menu such as the frozen hamburgers, is applied to the CPU by actuating the keyboard 15, a code serial number corresponding to the object, such as the frozen hamburger, is stored in the RAM. Thereafter, when a heating start signal which is inputted by the keyboard 15 is applied to the CPU, the first heating period TS1 is stored in the register a, and the first power level P1 is stored in the register b, and then, an initial output of the sensor means 1 is stored in the register c. The output of the sensor means 1 is stored into the register d for each sensing period. After starting the cooking and heating, the value of the first heating period TS1 stored in the register a is reduced each second. After the first heating period TS1, the register a outputs a borrow signal. The borrow signal is applied to the CPU, and then, the values of the second heating period TS2 and the second power level P2 which are readout from the ROM are stored in the registers a and b, respectively. Accordingly, the second power level P2 heating is carried out for the second heating period TS2. After the second heating period TS2, the register a outputs the borrow signal. The borrow signal is applied to the CPU, and then, the value of the third power level P3 stored in the ROM is introduced into the register b. The third power level P3 heating is carried out. In this case, the register a counts up per second till the output of the sensor means 1 reaches the predetermined heat completion value H. In other words, the register a counts up by the heat completion detection time t2 to calculate the period T.

The CPU is operated to detect whether the output of the sensor means has reached the predetermined heat completion value H. For example, when the difference between the value of the register d and the value of the register c becomes equal to or more than a predetermined value, it is judged that the output of the sensor means has reached the predetermined heat completion value H.

After the output of the sensor means 1 reaches the predetermined heat completion value H, the following equation 1 is calculated by the CPU to obtain the additive heating period T2.

$$T2 = N \times (TS1 + TS2 + T) \quad (1)$$

where (TS1+TS2+T) is a period from the heat start time t1 to the heat completion detection time t2, and N is an additive heating constant determined based on the type of the object.

The result of the equation (1) is stored in the register a, and then, the value of the additive heating power level P4 is stored in the register b from the ROM. The additive heating is carried out for the period T2 by the additive heating power level P4. The heating is stopped after the period T2.

The periods TS1 and TS2 are previously stored in the ROM dependent on the nature of the object. The heat completion value H is also stored into the ROM dependent on the nature of the object. The power levels P1, P2, P3, and P4 are previously stored into the ROM dependent on the nature of the object.

Although the ON-OFF switching of the high voltage transformer of the high voltage circuit is operated by the relay contact, a bidirectional silicon rectifier element may be used.

As descrived above, the heating appliance comprises the sensor means for detecting the gas, the vapor, the heat, the temperature, or the like, in the heating chamber, and the control circuit responsive to the output of the sensor means, for calculating the heat completion condition of the heated object, and for controlling the power levels of the heating source. Therefore, for the period between the heating start time and the heat completion detection time when the sensor means detects the heat completion value determined based on the quality and the amount of the object, the power levels of the heating source are changed periodically by the switching means. The switching means may be included in the control circuit.

In the present invention, the frozen object is heated and thawed to a certain extent by the first higher power level heating. After the first higher level heating, the second lower power level heating is carried out so that the heat of the object is expanded within the inner portion of the object by using the heat conductivity of the object itself to provide the unform heat distribution. Therefore, the first higher power heating and the second lower power heating provide a good thawing condition for heating and thawing the frozen object.

Further, in the present invention, if necessary, as described in the embodiment, a relatively higher power level heating, such as the third power level P3 heating, may be carried out before the heat completion detection time when the output of the sensor means reaches the heat completion detection value. If the relatively higher power level heating is carried out, the vapor, the gas, or the like, will be remarkably discharged from the heated object, and the output of the sensor means will be remarkably changed, so that the variations of the period between the heating start time and the heat completion detection time may be reduced. As a result, the variations in the heated condition of the object may be reduced, and the good heat completion may be obtained for cooking.

Although the first, second, third, and fourth power levels P1, P2, P3 and P4 of the heating source are about 100%, about 10%, about 70% and about 50% in the embodiment, the values of the power levels should not be limited to these values, and can be freely selected. For example, when both the relatively higher power heating such as the third power level P3 heating and the additive heating are carried out, P1>P3>P4>P2. If both the relatively higher power heating and the additive heating are not carried out, P1>P2. If the relatively high power heating is carried out and the additive heating is not carried out, P1>P3>P2.

As the third power level P3 heating and the additive heating are not necessarily needed, the first and the second power level heatings may be carried out at least to thaw the frozen object. Each of or both the third and the fourth power level heatings may be combined with the heating operation of the first and second power level heatings.

To achieve the objects of the present invention, the heating appliance comprises the heating means for heating the object, the detection means for detecting the heat completion of the heated object, the switching means for switching the power levels of the heating means from the first power level to the second power level lower than the first power level before the output of the detection means reaches the predetermined value. Therefore, the object can be uniformly heated or thawed. The switching means may be operated to switch the power level multiple time before the output of the detection means reaches the predetermined value.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A heating appliance comprising:

(a) heating means having at least a first, a second, a third and a fourth power level for heating an object, said heating means applying heat to the object during each power level, said third power level being greater than said second power level, said fourth power level being lower than said first power level;

(b) sensor means for sensing the heating condition of said object and outputting a signal representative thereof;

(c) detecting means, responsive to said output signal of said sensor means, for detecting whether said object has been heated to a predetermined heat completion condition;

(d) switching means for switching from said first power level to said second power level to said third power level of said heating means prior to the detection of said predetermined heat completion condition of said object being heated; and controlling means for controlling said heating means to provide an additive heating period at the fourth power level for heating said object after said detecting means detects that said predetermined heat completion condition has been reached, said additive heating period being determined by the type of said object and the length of time from the start of said heating to the detection of said heating completion condition.

2. The heating appliance of claim 1, wherein said sensor means senses at least one of gas, vapor, a temperature, and heat in said heating chamber or in the exhaust air from said heating chamber.

3. The heating appliance of claim 1, wherein said switching means switches from said first power level to said second power level after a first period of time, said first period of time being determined by the type of said object.

4. The heating appliance of claim 1, wherein said switching means switches from said second power level to said third power level after a second period of time, said second period of time being determined by the type of said object.

5. The heating appliance of claim 1, wherein said first power level is greater than said second power level.

* * * * *